US011206920B2

(12) United States Patent
Riebner et al.

(10) Patent No.: US 11,206,920 B2
(45) Date of Patent: Dec. 28, 2021

(54) ELECTRICALLY HEIGHT-ADJUSTABLE TABLE AND METHOD FOR CONTROLLING THE LATTER

(71) Applicant: Oelschläger Metalltechnik GmbH, Hoya/Weser (DE)

(72) Inventors: Florian Riebner, Stolzenau (DE); Thibaud Bucquet, Bremen (DE)

(73) Assignee: Oelschläger Metalltechnik Gmbh, Hoya/Weser (DE)

( * ) Notice: Subject to any disclaimer, the term of this patent is extended or adjusted under 35 U.S.C. 154(b) by 0 days.

(21) Appl. No.: 16/964,534

(22) PCT Filed: Jan. 31, 2018

(86) PCT No.: PCT/DE2018/100073
§ 371 (c)(1),
(2) Date: Jul. 23, 2020

(87) PCT Pub. No.: WO2019/149296
PCT Pub. Date: Aug. 8, 2019

(65) Prior Publication Data
US 2021/0030146 A1 Feb. 4, 2021

(51) Int. Cl.
*A47B 9/00* (2006.01)

(52) U.S. Cl.
CPC ..... *A47B 9/00* (2013.01); *A47B 2200/0042* (2013.01); *A47B 2200/0056* (2013.01); (Continued)

(58) Field of Classification Search
CPC ..... A47B 9/00; A47B 2200/0042; A47B 2200/0056; A47B 2200/0062; A47B 2220/0091
See application file for complete search history.

(56) References Cited

U.S. PATENT DOCUMENTS

2014/0109802 A1 4/2014 Dienes et al.
2014/0137773 A1 5/2014 Mandel et al.
(Continued)

FOREIGN PATENT DOCUMENTS

DE 202006018530 U1 3/2007
DE 102016101954 A1 8/2017
(Continued)

*Primary Examiner* — Matthew W Ing
(74) *Attorney, Agent, or Firm* — Jonathan M. D'Silva; MMI Intellectual Property

(57) ABSTRACT

Electrically height-adjustable table (10) comprising: an electrically height-adjustable base frame (14), a tabletop (12) which is arranged at or on the base frame (14), a drive device for adjusting the height of the base frame (14)/the tabletop (12), wherein the drive device is fastened to the base frame (14) or to the tabletop (12) and comprises at least one electric motor, a control device (70) and an operating device for operating the control device (70), and a sensor device (72) for detecting an initial absolute inclination of the tabletop (12) upon receiving an input of a movement command via the operating device and for detecting a subsequent absolute inclination and a subsequent temporal inclination change of the tabletop (12) during the movement of the tabletop (12) up or down according to the movement command, wherein the sensor device (72) comprises a three-axis acceleration sensor (74) for determining the absolute inclination of the tabletop (12) and a three-axis gyroscope (73), preferably integrally therewith, for determining the temporal inclination change of the tabletop (12).

24 Claims, 8 Drawing Sheets

(52) U.S. Cl.
CPC ..... *A47B 2200/0062* (2013.01); *A47B 2220/0091* (2013.01)

(56) References Cited

U.S. PATENT DOCUMENTS

| | | | | |
|---|---|---|---|---|
| 2016/0309889 | A1 | 10/2016 | Lin et al. | |
| 2018/0368569 | A1* | 12/2018 | Laing | A47C 19/024 |
| 2020/0146440 | A1* | 5/2020 | Fogarty | A47B 9/00 |
| 2020/0178682 | A1* | 6/2020 | Deng | A47B 9/04 |
| 2020/0221863 | A1* | 7/2020 | Laing | A47B 9/04 |
| 2021/0000250 | A1* | 1/2021 | Hoyer | A47B 9/00 |
| 2021/0011453 | A1* | 1/2021 | Xiang | G05B 19/402 |
| 2021/0145164 | A1* | 5/2021 | Lu | A61G 7/018 |

FOREIGN PATENT DOCUMENTS

| | | | |
|---|---|---|---|
| WO | 2009003918 | A1 | 1/2009 |
| WO | 2015058883 | A1 | 4/2015 |

* cited by examiner

ELECTRICALLY HEIGHT-ADJUSTABLE TABLE AND METHOD FOR CONTROLLING THE LATTER

BACKGROUND

The present application relates to an electrically height-adjustable table and to a method for controlling the latter. In particular, the application also involves an apparatus and a method for detecting collisions in the case of an electrically height-adjustable table.

When moving a height-adjustable tabletop of a table up or down, collisions with obstacles, for example walls or objects, may arise, which can damage the table or the obstacle. It is also critical if persons or animals collide with the table, which can entail injuries, for example bruising. In order to reduce the risk of injury and damage, it is necessary to detect a collision with an obstacle in order to be able to take suitable measures, for example interrupt the movement of the tabletop after the collision or move the tabletop back.

EP 1 891 872 B1 discloses an apparatus and a method for detecting collisions in the case of furniture and relates, in particular, to an apparatus and a method for detecting collisions of automatically movable parts of furniture with obstacles by capturing a bending change. The known apparatus comprises a sensor which is adapted to capture a bending change of the movable part and contains a piezoelectric material and is a piezoelectric diaphragm for generating sound signals. A bending change of an attachment location of the movable part is captured by the sensor upon collision of the movable part with an obstacle by changing a compression or extension of the piezoelectric material in the event of the bending change of the location of the movable part and generating an electrical signal by means of the piezoelectric material when the compression or extension is changed.

EP 1 837 723 A2 describes a multipart piece of furniture having at least one electromotive drive which is provided for the purpose of adjusting a furniture part which can be moved in two opposite directions, wherein a control system comprises a safety device which is effective during adjustment of the furniture part and is provided for the purpose of preventing impermissible operating states, wherein the safety device is assigned an inclination sensor which is fitted to the movable furniture part and the output signal from which is evaluated by the safety device in order to detect an impermissible position of the movable furniture part. A capacitive acceleration sensor having a micro-mechanical sensor element can be used as the inclination sensor.

DE 20 2007 006 673 U1 relates to an electrically height-adjustable table comprising a height-adjustable base frame, a tabletop which is arranged on the base frame, at least one drive device for adjusting the height of the base frame/tabletops, in which the drive device is fastened to the base frame and/or the tabletop, wherein the drive device comprises at least one electric motor for the operation thereof, a control part for controlling the drive device and an operating device for activating the control part, wherein the table comprises a "tilt apparatus" which causes the stopping or the reversing and then stopping of the drive device if the table is inclined.

DE 10 2006 038 558 A1 relates to an arrangement for controlling the drive of an electrically adjustable piece of furniture. Said arrangement has a control device which is connected to at least one motor and to an operating device. Furthermore, at least one acceleration sensor arranged on the furniture is connected to the control device, and the control device is designed in such a manner that, in the event of an acceleration measured by the acceleration sensor, the at least one motor is controlled in such a manner that the movement of the furniture is stopped.

DE 10 2016 102 382 A1 relates to an electrically adjustable table and to a control method for the electrically adjustable table. The control method for the electrically adjustable table contains the following steps: initializing an internal setting or a user setting, entering a quiescent status, extending or retracting a table foot in order to adjust the height of a tabletop, which moves in a first direction, in accordance with an operation on a manual control apparatus, stopping the adjustment of the height of the tabletop if a motion sensor unit is used and detects that the table top is inclined during the adjustment of the height of the tabletop. The motion sensor unit is a gyroscope or an acceleration measuring sensor.

Finally, DE 10 2016 101 955 A1 discloses an electrically adjustable piece of furniture. The piece of furniture has an electrical drive motor for adjusting at least one furniture adjustment section with respect to a furniture carrier section, wherein the piece of furniture is provided with a sensor device for detecting the inclination or inclination change of the furniture adjustment section. The sensor device may comprise a gyroscopic sensor which can be used to determine the inclination or inclination or angle change of the furniture adjustment section. In addition, the sensor device may comprise a gravity sensor which can be used to determine the absolute inclination of the furniture adjustment section.

However, in the above-mentioned prior art, the sensor devices cannot be positioned in any desired orientation on an electrically height-adjustable table for correctly detecting collisions. This complicates assembly and therefore results in higher production costs.

SUMMARY

The present invention is therefore based on the object of enabling any desired positioning of a sensor device for detecting a collision in an electrically height-adjustable table.

According to the invention, this object is achieved by means of an electrically height-adjustable table comprising: an electrically height-adjustable base frame, a tabletop which is arranged at or on the base frame, a drive device for adjusting the height of the base frame/the tabletop, wherein the drive device is fastened to the base frame or to the tabletop and comprises at least one electric motor, a control device and an operating device for operating the control device, and a sensor device for detecting an initial absolute inclination of the tabletop upon receiving an input of a movement command via the operating device and for detecting a subsequent absolute inclination and a subsequent temporal inclination change of the tabletop during the movement of the tabletop up or down according to the movement command, wherein the sensor device comprises a three-axis acceleration sensor for determining the absolute inclination of the tabletop and a three-axis gyroscope, preferably integral therewith, for determining the temporal inclination change of the tabletop, preferably wherein the acceleration sensor and the gyroscope are accommodated in a micro-electromechanical system (MEMS) component, wherein the sensor device also comprises a computing device, in particular a microprocessor, which, in order to determine the initial absolute inclination of the tabletop each time before executing an input movement command, is configured to cause initial capture of acceleration components by means of the acceleration sensor in a three-dimensional Cartesian coordinate system oriented on the basis of the installation orientation of the acceleration sensor and a comparison of the captured acceleration components with known acceleration components under the same conditions in a global three-dimensional Cartesian coordinate system, wherein the z-axis of said coordinate system is oriented in the direction of gravitational acceleration, and a possible offset correction of the captured acceleration components and a possible inversion of the acceleration component in the z direction and a conversion of the captured and possibly offset-corrected and/or possibly inverted acceleration components into an inclination angle or vector and, in order to accordingly determine an absolute inclination of the tabletop by capturing acceleration components by means of the acceleration sensor and in order to determine a temporal inclination change of the tabletop or a variable representative of the temporal inclination change of the tabletop during the subsequent execution of the movement command by capturing angular velocity components by means of the gyroscope, is configured to cause a possible inversion of the angular velocity components and a summation of the angular velocity components and a comparison of the determined sum of the angular velocity components with a predefined angular velocity limit value.

This object is also achieved by means of a method for controlling an electrically height-adjustable table as claimed in one of the preceding claims, comprising: receiving, at the operating device, an input of a movement command by a user, determining, in response to the movement command, an initial absolute inclination of the tabletop by means of the computing device by initially capturing acceleration components via the acceleration sensor in a three-dimensional Cartesian coordinate system oriented on the basis of the installation orientation of the acceleration sensor and comparing the captured acceleration components with known acceleration components under the same conditions in a global three-dimensional Cartesian coordinate system, wherein the z-axis of said coordinate system is oriented in the direction of gravitational acceleration, and possibly correcting the offset of the captured acceleration components and possibly inverting the acceleration component in the z direction and converting the captured and possibly offset-corrected and/or inverted acceleration components into an inclination angle or vector, and subsequently moving the tabletop up or down according to the movement command via the drive device, and determining an absolute inclination of the tabletop by capturing acceleration components by means of the acceleration sensor and determining a temporal inclination change of the tabletop or a variable representative of the temporal inclination change of the tabletop by means of the computing device during movement, wherein the temporal inclination change of the tabletop is determined by capturing angular velocity components via the gyroscope, possibly inverting the angular velocity components and summing the angular velocity components and comparing the determined sum of the angular velocity components with a predefined angular velocity limit value.

In the case of the table, provision may be made for the control device to be configured to stop the drive device or to control it in the opposite direction if the determined sum of the angular velocity components exceeds the angular velocity limit value, and/or wherein the control device is configured to stop the drive device or to control it in the opposite direction if the determined absolute inclination exceeds a predefined inclination limit value. This is because, if the sum of the angular velocities and thus the inclination change or the variable representative thereof exceeds the limit value, it is assumed that a collision has occurred, and a countermeasure is then taken.

Provision may also be made for the control device to be configured to control the drive device on the basis of the determined inclination or the determined temporal inclination change of the tabletop or the determined variable representative of the temporal of the tabletop.

According to a further particular embodiment, the sensor device can be fastened, preferably releasably, to the tabletop, preferably by means of adhesive bonding. For example, the sensor device can be fastened on or under the tabletop.

The sensor device is advantageously fastened, preferably releasably, in the operating device. For example, the sensor device can be fastened in a manual switch.

Alternatively, the sensor device can be integrated in the control device.

The operating device advantageously has a manual switch device.

According to a further particular embodiment of the present invention, the table has a display device which is configured to display the location and/or the magnitude of a determined inclination change. The term "magnitude" is intended to comprise the "absolute value". If necessary, a direction of the inclination change can also be alternatively or additionally displayed on the display device. In this case, the term "determined inclination change" can relate both to the temporal inclination change (°/s) and to the change in the inclination (in °).

The table expediently has a database which is configured to store the location and/or the magnitude of a determined inclination change.

In this case, provision may be made, in particular, for the display device to be in the vicinity of or inside the operating device, in particular to be an integral part of the latter.

In the method, provision may be made for the method to comprise stopping the drive device or controlling the drive device in the opposite direction if the determined sum of the angular velocity components exceeds the angular velocity limit value, and/or stopping the drive device or controlling the drive device in the opposite direction if the determined absolute inclination exceeds a predefined inclination limit value.

In addition, provision may be made for the method to comprise controlling the drive device, by means of the control device, on the basis of the determined inclination or determined temporal inclination change of the tabletop or determined variable representative of the temporal inclination change of the tabletop.

The method may also comprise displaying, by means of the display device, the location and/or the magnitude of a determined inclination change of the tabletop.

Finally, the method advantageously comprises storing, by means of the database, the location and/or the magnitude of a determined inclination change of the tabletop.

The present invention is based on the surprising realization that any desired positioning and orientation of the sensor device on the electrically height-adjustable table is possible by combining a three-axis acceleration sensor with a three-axis gyroscope and, if necessary, correcting the measurement data on the basis of the installation orientation of the sensors—can also be mathematically referred to as coordinate transformation. The "coordinate transformation" is carried out in this case in an upstream initialization process. In said initialization process, the actual installation direction(s) of the sensor device or sensors is/are determined indirectly and the measured values for the inclination are then corrected on the basis of the actual installation direction(s). The sensor device can even be positioned without a tool, at least in a particular embodiment.

On the basis of an absolute inclination determined during initialization, common acceleration sensors can usually measure from approximately 0.5° owing to their design.

The gyroscope can be used to determine a fast inclination change, such as during a collision. A "fast" inclination change is intended to mean here an angular velocity of ≥1°/s (sum of all sensors). For example, sensor data can be captured every 10 ms and can possibly be converted and compared before a decision is made. In addition, the data can then be deleted for new measurements.

BRIEF DESCRIPTION OF DRAWINGS

Further features and advantages of the invention emerge from the accompanying claims and the following description in which a plurality of exemplary embodiments are explained in detail on the basis of the schematic drawings, in which:

DETAILED DESCRIPTION

Figure 1:
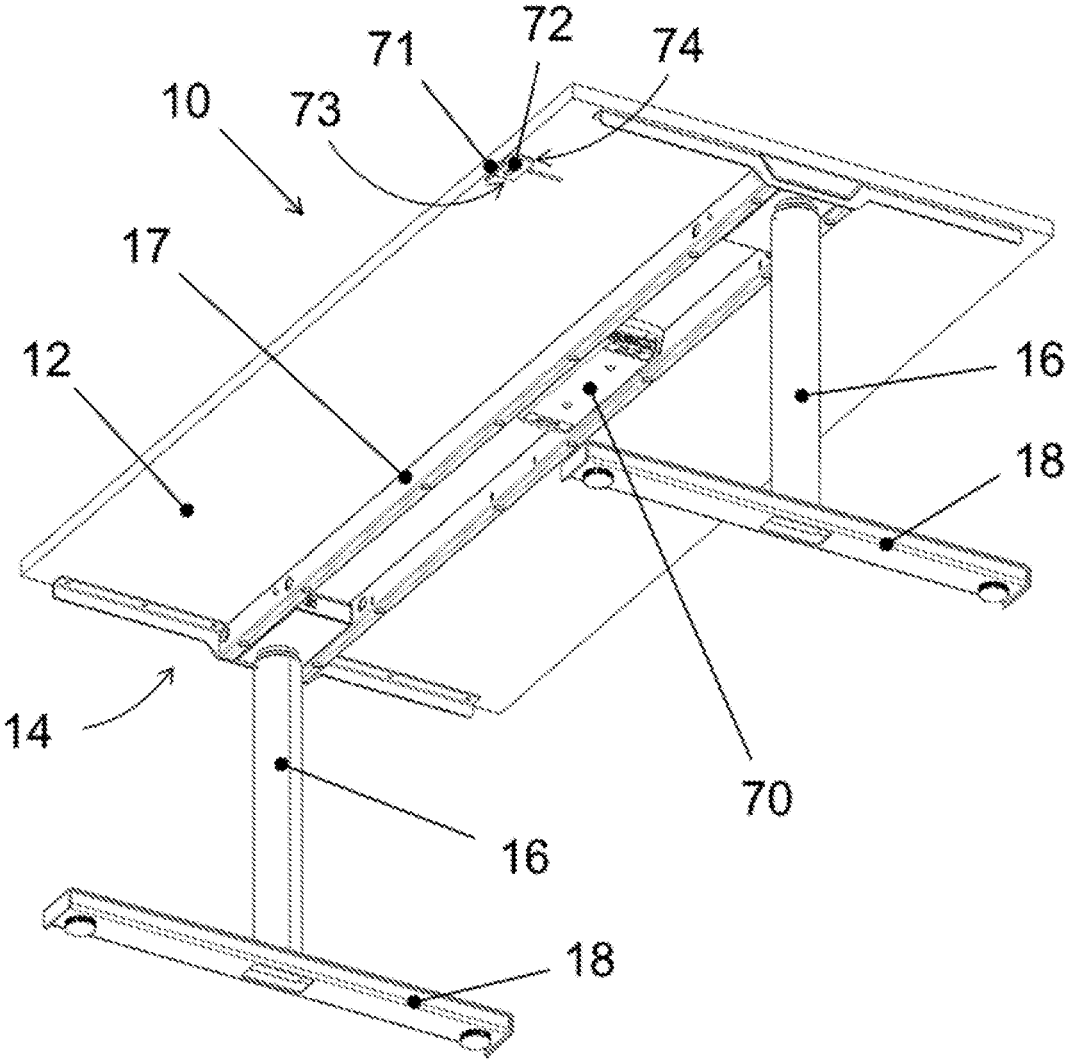
FIG. 1 shows a perspective view (obliquely from below) of an electrically height-adjustable table according to one particular embodiment of the present invention.
Figure 2:
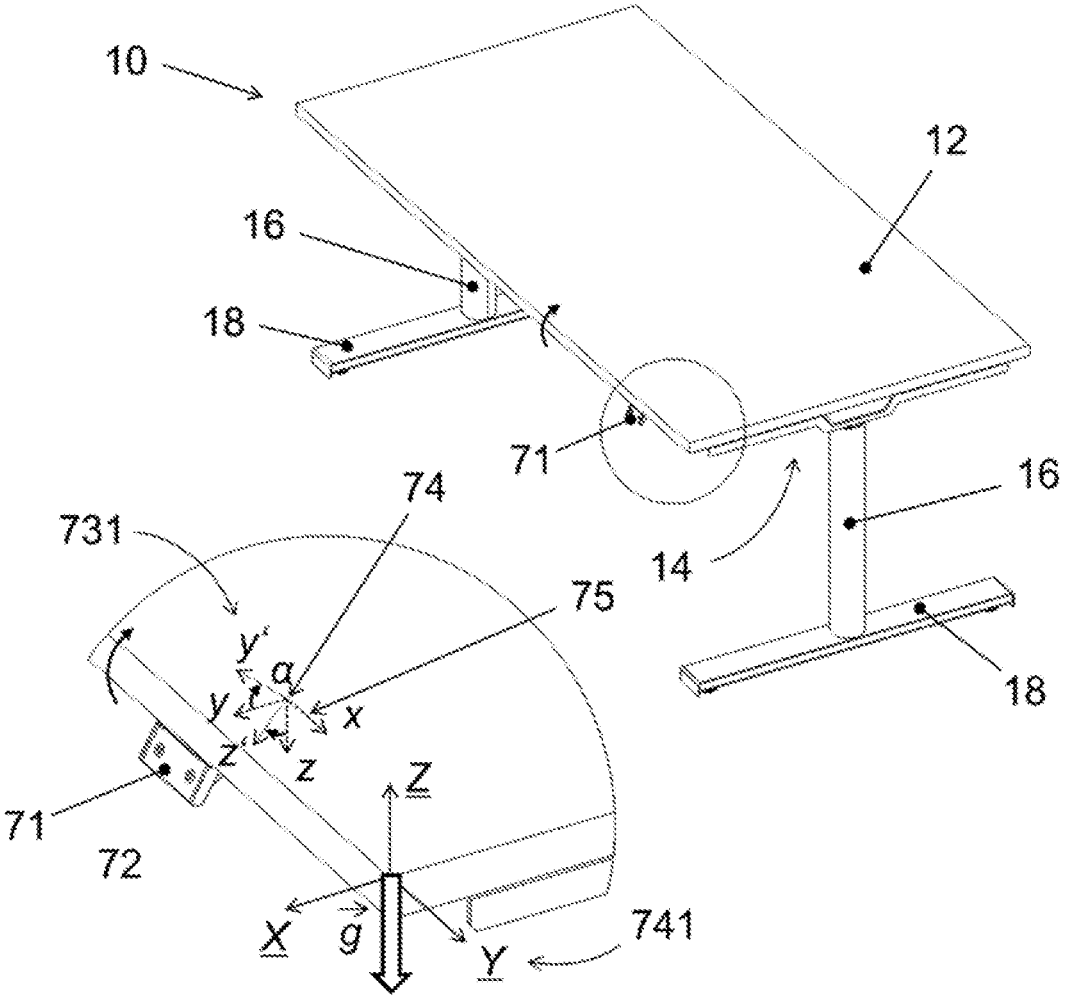
FIG. 2 shows the table from FIG. 1 in a perspective view (obliquely from above) and a detailed view.
Figure 3:
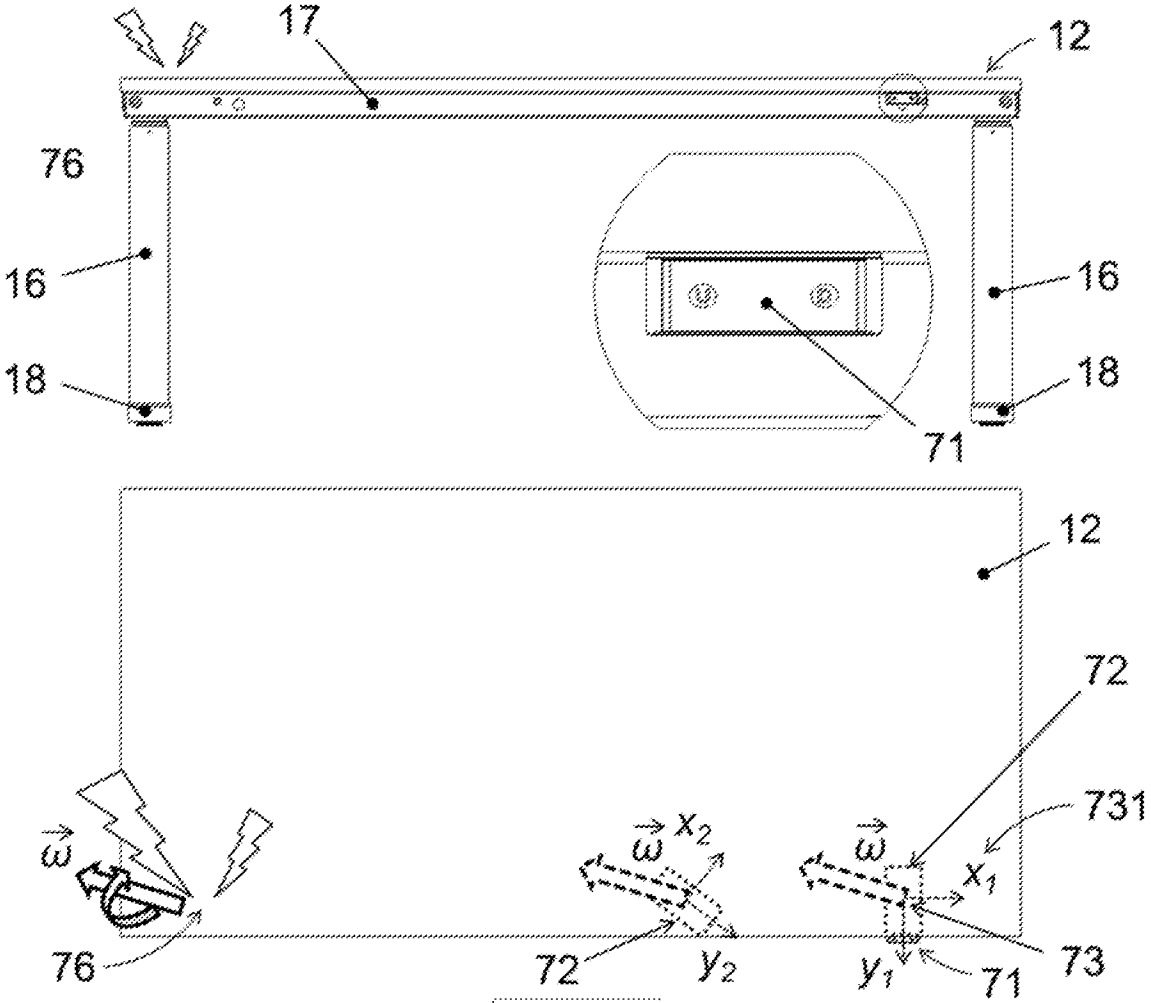
FIG. 3 shows a side view and a plan view of the table from FIG. 1.

FIGS. 1, 2 and 3 show an electrically height-adjustable table 10 according to one particular embodiment of the present invention. The table 10 comprises an electrically height-adjustable base frame 14 with two lateral table legs 16 each with a table foot 18 and a crossmember 17 connecting the two table legs 16, a tabletop 12 which is arranged on the base frame 14 and is releasably fastened thereto, a drive device (not shown) for adjusting the height of the base frame 14 and therefore also of the tabletop 12, wherein the drive device is fastened to the base frame 14 and comprises at least one electric motor (not shown), a control device 70, in this example in the crossmember 17, and an operating device for operating the control device 70, for example in the form of a manual switch 71, and a sensor device 72 for detecting an initial absolute inclination of the tabletop 12, which is usually initially at rest, upon receiving an input of a movement command via the manual switch 71 and for detecting a subsequent absolute inclination and a subsequent temporal inclination change of the tabletop 12 during the movement of the tabletop up or down according to the movement command. The sensor device 72 comprises a three-axis acceleration sensor 74 for determining the absolute inclination of the tabletop 12 and a three-axis gyroscope 73, integral therewith, for determining the temporal inclination change of the tabletop 12 or a variable representative thereof, wherein the acceleration sensor 74 and the gyroscope 73 are accommodated in a micro-electromechanical system (MEMS) component. The sensor device 72 also includes a computing device (not shown), for example a microprocessor or at least one microprocessor, which, in order to determine the initial absolute inclination of the tabletop 12 each time before executing an input movement command, is configured to cause initial capture of acceleration components by means of the acceleration sensor 74 in a three-dimensional Cartesian coordinate system 731 (see FIG. 2) oriented on the basis of the installation orientation of the acceleration sensor, a comparison of the captured acceleration components with known acceleration components under the same conditions in a global three-dimensional Cartesian coordinate system 741 (see FIG. 2), wherein the z-axis of said coordinate system is oriented in the direction of gravitational acceleration, and a possible offset correction of the captured acceleration components and a possible inversion of the acceleration component in the z direction and a conversion of the captured and possibly offset-corrected and/or inverted acceleration components into an inclination angle or vector and, in order to accordingly determine an absolute inclination of the tabletop 12 by capturing acceleration components by means of the acceleration sensor 74 and in order to determine a temporal inclination change of the tabletop 12 or a variable representative of the temporal inclination change of the tabletop 12 during the subsequent execution of the movement command by capturing angular velocity components by means of the gyroscope 73, is configured to cause a possible inversion of the angular velocity components and a summation of the angular velocity components and a comparison of the determined sum of the angular velocity components with a predefined angular velocity limit value.

In the embodiment shown here, the sensor device 72 is located in the manual switch 71. As a result, there is no need for a separate housing for the sensor device and there is also no need to provide a further plug connection on the control device. As is intended to be expressed by the coordinates y' and x' in FIG. 2, an inclination of the tabletop 12 can be effected about the x-axis (horizontal axis), for example, in the event of a collision. The inclination or inclination change can be detected by means of the sensor device 72.

More precisely, FIG. 2 illustrates collision detection by means of the acceleration sensor 74. After initialization (tabletop 12 at rest) (inclination angle set equal to zero), a first local coordinate system 731 (x, y, z) is detected. If the tabletop 12 is inclined about the x-axis 75 during movement, the local coordinate system (x', y', z') changes. The gravitational acceleration is now no longer measured using the single z-axis (exemplary case), but also using the y'-axis. The inclination angle $\alpha$ can be measured by means of an arc tangent calculation between the projected y' values and z' values of the acceleration and can be compared with an inclination limit value (for example at 0.5°). If the inclination angle $\alpha$ reaches or exceeds the inclination limit value, the tabletop is stopped in this example (movement of the tabletop is aborted).

FIG. 3 is intended to illustrate a collision of the tabletop 12 in a plan view at the front left (collision location 76). The collision or inclination of the tabletop is identified by the rotation vector $\vec{\omega}$. Irrespective of where and how the sensor apparatus 72 is arranged, the temporal inclination change can be determined using the rotation vector. This shall be explained briefly for two examples. If the sensor apparatus 72 is situated in a first example as illustrated on the very right at the bottom of FIG. 3, the rotation vector can be represented in the illustrated $x_1$, $y_1$ plane of a local coordinate system 731. In a second example (slightly to the right at the bottom of FIG. 3), the sensor apparatus 72 is rotated about the z-axis ((x1, y1, z1) becomes (x2, y2, z1)). This does not influence the sensor evaluation since the angular velocities in °/s (as a vectorial variable) can be added. The value gyro_sum=gyro_x+gyro_y+gyro_z (where gyro_z=0°/s in FIG. 3) is compared with a second limit value, for example of 1.0°/s (=brief inclination change). As soon as the value of the sum exceeds the second limit value, the control of the movement is aborted.

Figure 5:
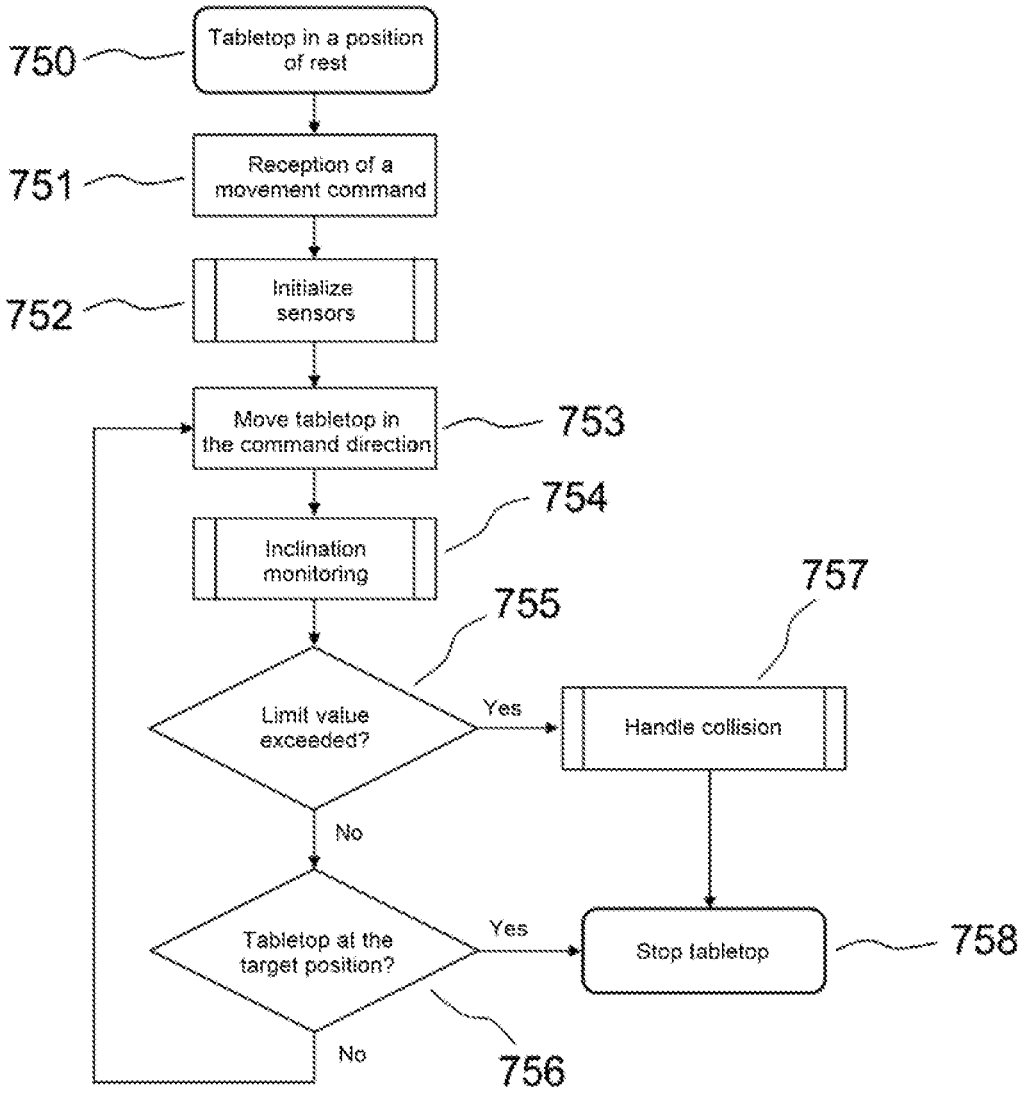
FIG. 5 shows a flowchart of a method for controlling the table from FIGS. 1 and 2, for example, according to one particular embodiment of the present invention.

FIG. 5 shows, in rough steps, how the table according to FIGS. 1 and 2, for example, can be controlled. Initially, the tabletop 12 is in a position of rest (step 750). If a movement command is then received from a user via the manual switches 71 (step 751), the sensors are first of all initialized (step 752), that is to say the acceleration sensor 74 and the gyroscope 73 in this case, during the course of which the absolute inclination of the tabletop 12 is determined by means of the acceleration sensor 74. After the absolute inclination of the tabletop 12 has been determined, movement of the tabletop 12 begins in the direction predefined by the movement command (command direction, step 753). During the movement of the tabletop 12, the absolute inclination of the tabletop is monitored (754). A check is also carried out in order to determine whether the determined temporal inclination change has exceeded a predefinable limit value, here an angular velocity limit value in this example (step 755). If so, a collision is assumed and "countermeasures" are carried out in a step 757 or a sequence of steps. The countermeasures usually comprise immediately stopping the tabletop 12 or moving the tabletop in the opposite direction and then stopping the tabletop (step 758).

If the limit value, here an angular velocity limit value in this example, is not exceeded, a check is also carried out in order to determine whether the tabletop has reached the target position according to the movement command (step 756). If so, the tabletop is stopped (step 758). If not, the tabletop is moved further according to the movement command (step 753).

Figure 6:
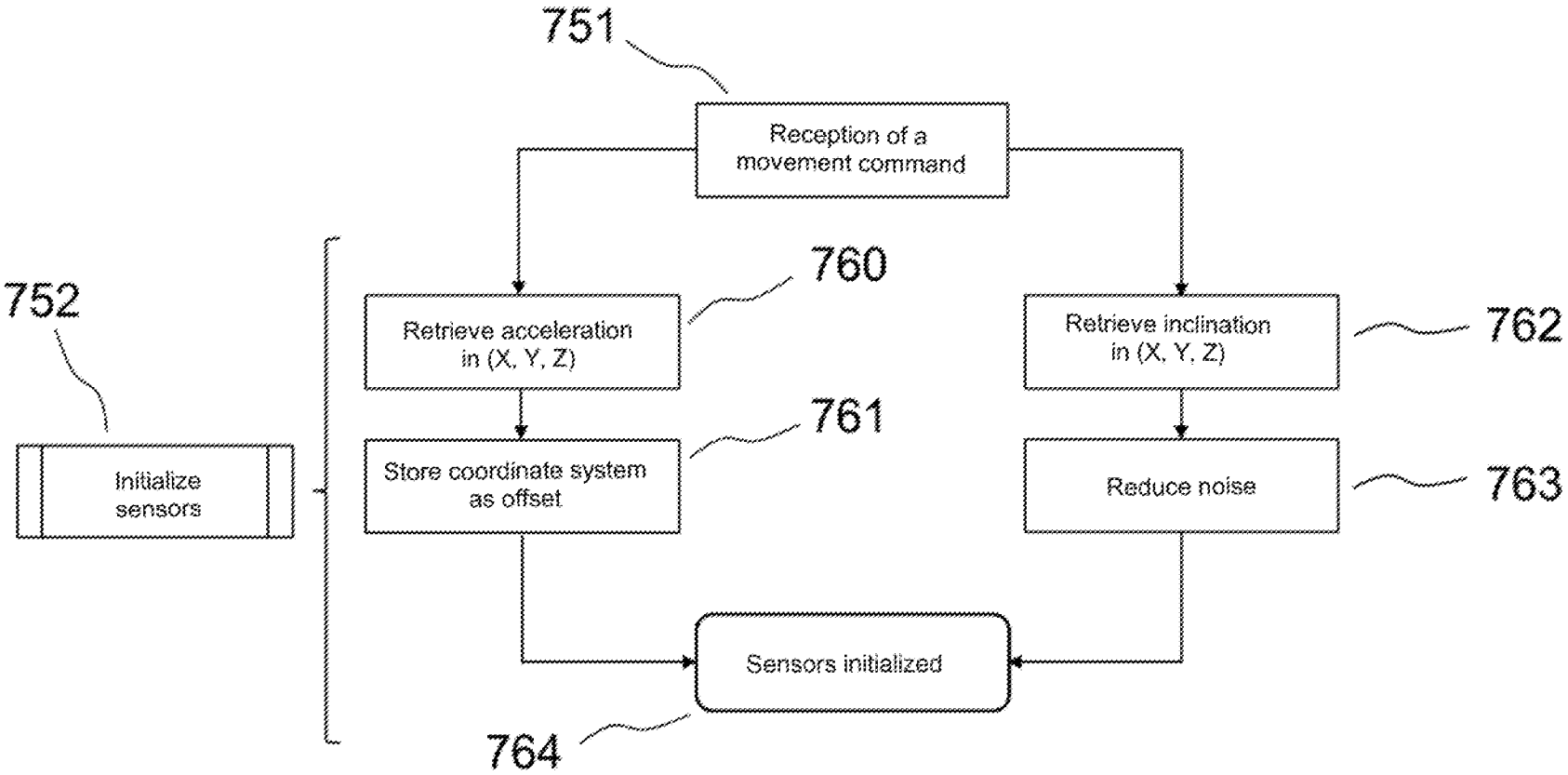
FIG. 6 shows a flowchart of a "sub-method" of the method from FIG. 5.

FIG. 6 shows details of the initialization of the sensors according to one particular embodiment of the present invention. The starting point or trigger is the reception of a movement command from a user (step 751). The sensor data are first of all initialized at a standstill by retrieving the accelerations in the x, y and z directions from the acceleration sensor (step 760) and the angular velocities from the gyroscope (step 762). The local coordinate system 731 is first of all stored as the offset for the subsequent evaluations (step 761) and the measurement noise of the gyroscope is reduced directly by the microprocessor after a brief reference recording (step 763). The offset is the gravitational acceleration which is projected in the x, y and z directions (only measurable acceleration if the tabletop is at a standstill) and is stored during initialization. The offset of the measured data is corrected by using the offset data stored during initialization in the respective components. The sensors are then initialized as a result (764).

Figure 7:
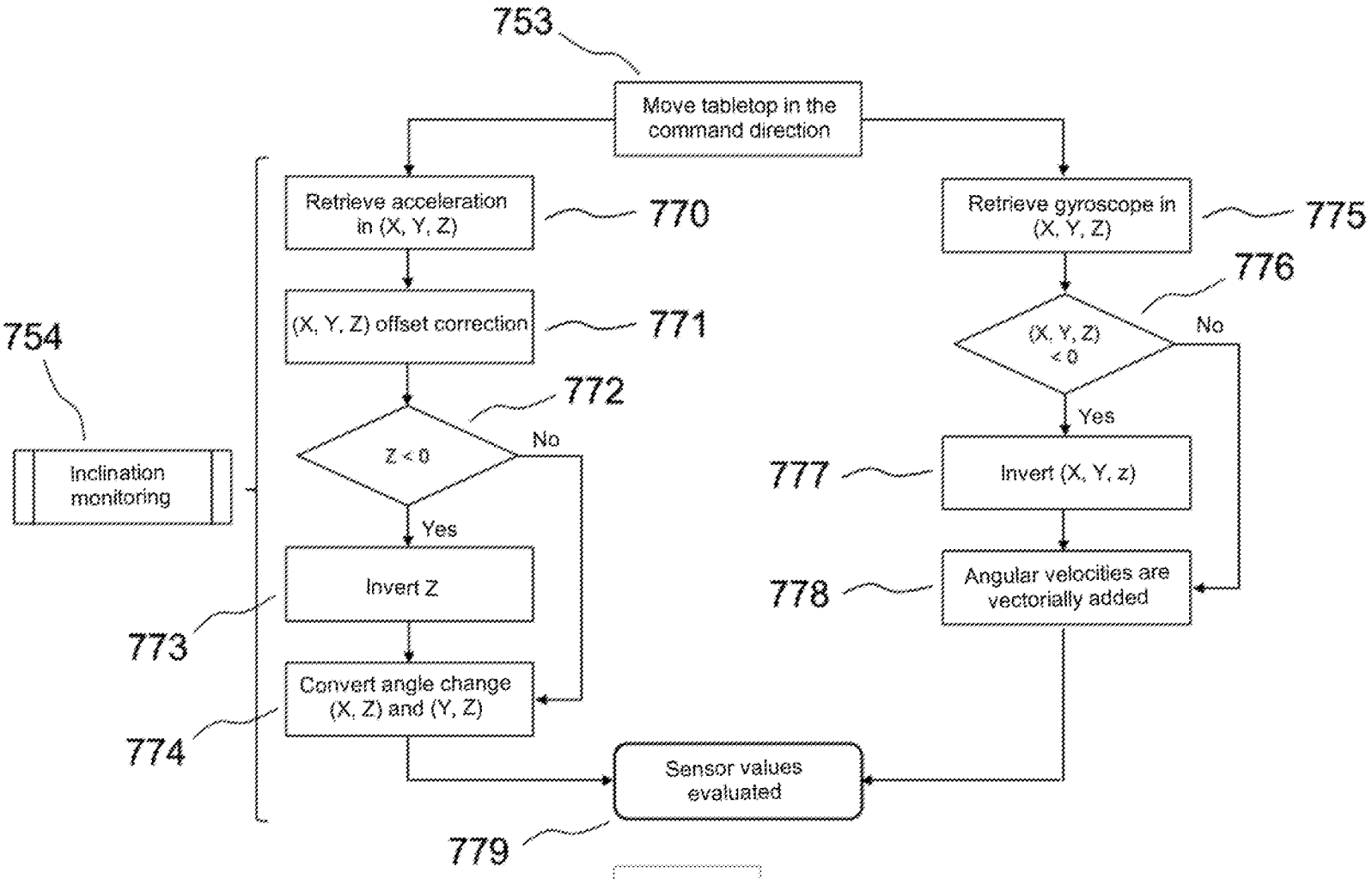
FIG. 7 shows a flowchart of a "sub-method" of the method from FIG. 5.

FIG. 7 shows details of the inclination monitoring according to one particular embodiment of the present invention. After the table has entered a movement mode (753), the sensor data are retrieved continuously or at intervals, wherein, in order to determine an inclination change, sensor data from the acceleration sensor which representative of acceleration components in the x, y and z directions and are retrieved (step 770), an offset correction is carried out for the transformation into the global coordinate system 741 (step 771) and a z component inversion (step 773) is possibly carried out for calculating an angle change with the x and y components (step 774). Temporal inclination changes are taken into account in a parallel manner by retrieving the sensor data from the gyroscope 73 in the x, y and z directions (step 775), possibly inverting the x, y and/or z component if negative (step 776) and summing the x, y and z components.

Figure 8:
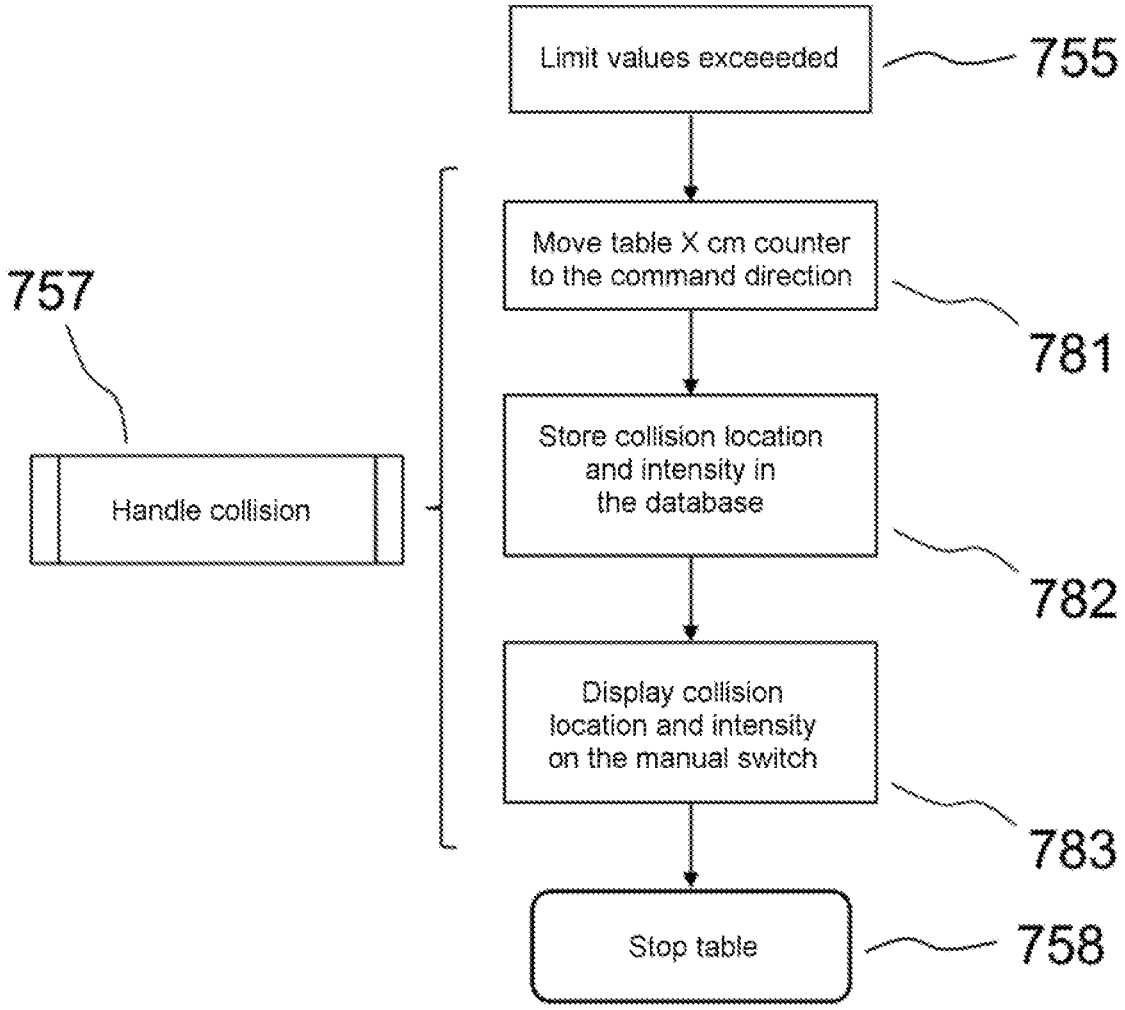
FIG. 8 shows a flowchart of a "sub-method" of the method from FIG. 5.

FIG. 8 shows details of the handling of a collision according to one particular embodiment of the present invention. If the check in step 755 has revealed that there is possibly a collision, the tabletop is moved X cm in the opposite direction to the movement command (step 781). The collision location and/or the intensity of the collision can then also be optionally determined and can be stored, for example, in a database (step 782) and/or displayed by means of a display device (step 783). The tabletop is finally stopped (step 758).

Figure 4:
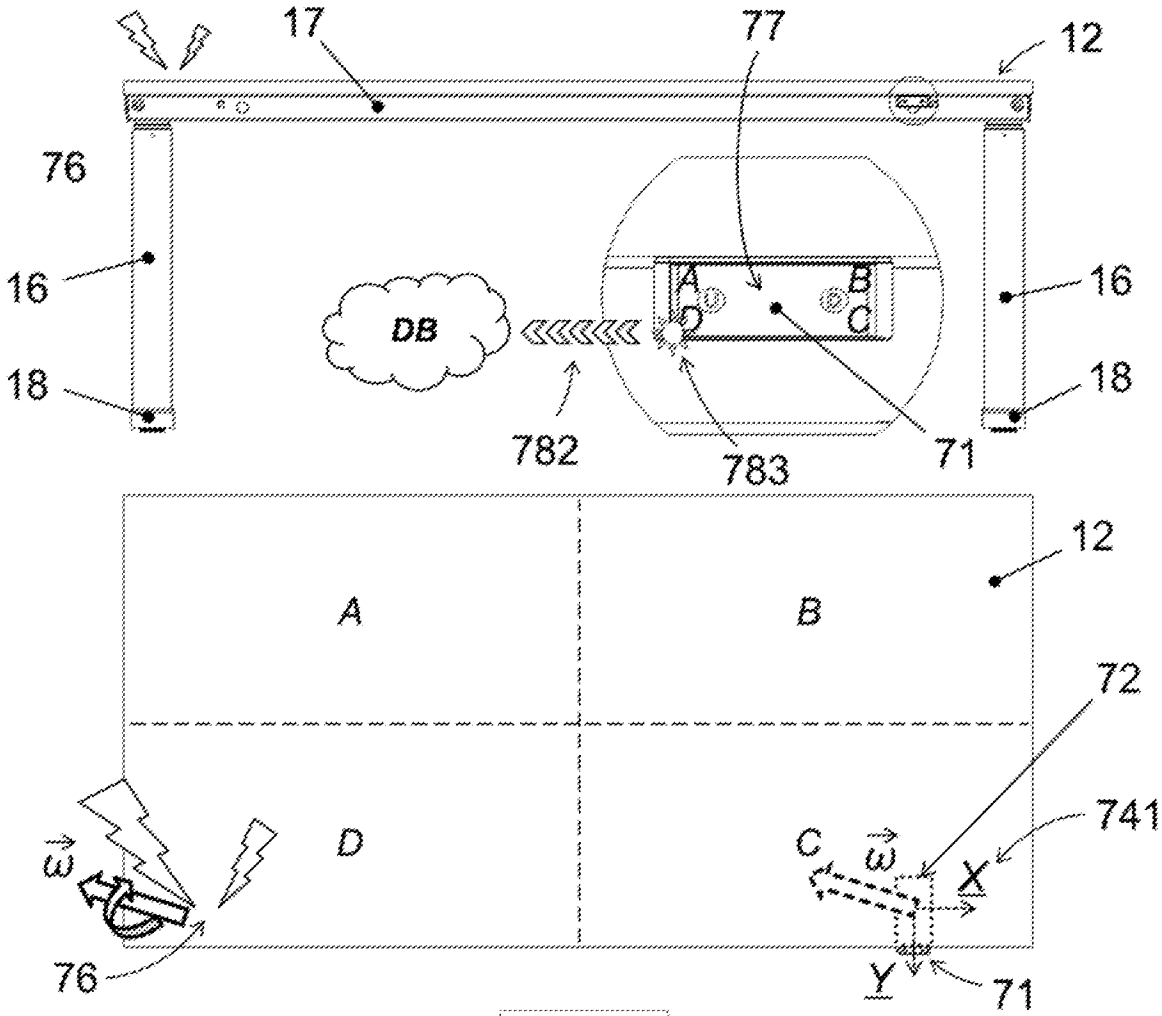
FIG. 4 shows a side view of an electrically height-adjustable table according to a further particular embodiment of the present invention and a detailed view of a display device of the table.

In the case of the exemplary electrically height-adjustable table 10 shown in FIG. 4 according to one particular embodiment of the present invention, the operating device, for example in the form of a manual switch 71, has a display device 77 which is integral in this example and has a rectangular display area which is subdivided into subareas A, B, C and D. The reference number 783 according to FIG. 8 is intended to express the fact that the collision location 76 is displayed at the bottom left in the subarea D by means of the display device 77. In addition, the reference number 782 according to FIG. 8 is intended to express the fact that the collision location 76 and the collision intensity are stored in a database DB.

More precisely, FIG. 4 shows the possibility that the entire sensor device 72 is used as a localization tool for collisions in a global coordinate system since both parts (gyroscope and acceleration sensor) can be located. Depending on the subarea or sector A, B, C and D in which a collision occurs, this collision is evaluated differently in the sensors (gyroscope and acceleration sensor). For the gyroscope 73, the signs of the x and y components of the rotation vector in the coordinate system 741 are considered. For example, in the case of the rectangular tabletop which is shown in FIG. 4 and is held by means of a crossmember 17 as in FIG. 1, the following signs result for the x and y components of the rotation vector: sector D (−x; −y), sector C (−x; +y), sector B (+x, +y) and sector A (+x; −y). In the case of the acceleration sensor, the location is detected using the sign of the value z' projected onto the x, y plane of the coordinate system (see FIG. 2).

The angular velocities determined by means of the gyroscope are no longer specifically added for this type of evaluation, but rather are considered individually (signs) depending on the sector. Therefore, it is necessary to integrate the sensor device in a known positioned system (global coordinate system 741) (X, Y, Z) (also see FIG. 2) (for example manual switch or controller) in order to be able to locate the collision depending on measured values.

The features of the invention disclosed in the above description, the drawings and the claims can be essential to the implementation of the invention in its various embodiments both individually and in the arbitrary combinations.

LIST OF REFERENCE SIGNS

10 Table
12 Tabletop
14 Base frame
16 Table leg
18 Table foot
17 Crossmember
70 Control device
71 Manual switch
72 Sensor device
73 Gyroscope
74 Acceleration sensor
75 x-axis
76 Collision
77 Display device
731 Coordinate system
741 Global coordinate system
A, B, C, D Subareas
DB Database
α Inclination angle

The invention claimed is:

1. An electrically height-adjustable table comprising:

an electrically height-adjustable base frame;

a tabletop arranged at or on said base frame;

a drive device for adjusting the height of said base frame and said tabletop, wherein said drive device is fastened to said base frame or to said tabletop and comprises at least one electric motor, a control device and an operating device for operating said control device, and a sensor device for detecting an initial absolute inclination of said tabletop upon receiving an input of a movement command via said operating device and for detecting a subsequent absolute inclination and a subsequent temporal inclination change of said tabletop during movement of said tabletop up or down according to said movement command, wherein said sensor device comprises a three-axis acceleration sensor for determining the absolute inclination of said tabletop and a three-axis gyroscope for determining the temporal inclination change of said tabletop, wherein said sensor device also comprises a computing device, which, in order to determine the initial absolute inclination of said tabletop each time before executing an input said movement command, is configured to cause initial capture of acceleration components by means of said acceleration sensor in a three-dimensional Cartesian coordinate system oriented on the basis of the installation orientation of said acceleration sensor and a comparison of the captured acceleration components with known acceleration components under the same conditions in a global three-dimensional Cartesian coordinate system, wherein the z-axis of said coordinate system is oriented in the direction of gravitational acceleration, and a conversion of the captured acceleration components into an inclination angle or vector and, in order to accordingly determine an absolute inclination of said tabletop by capturing acceleration components by means of said acceleration sensor and in order to determine a temporal inclination change of said tabletop or a variable representative of the temporal inclination change of said tabletop during the subsequent execution of said movement command by capturing angular velocity components by means of said gyroscope, is configured to cause a summation of the angular velocity components and a comparison of the determined sum of the angular velocity components with a predefined angular velocity limit value.

2. The table of claim 1, further comprising said control device is configured to stop said drive device or to control it in the opposite direction if the determined sum of the angular velocity components exceeds the angular velocity limit value, or exceeds a predefined inclination limit value.

3. The table of claim 1 further comprising said control device is configured to control said drive device on the basis of the determined inclination or the determined temporal inclination change of said tabletop or the determined variable representative of the temporal inclination change of said tabletop.

4. The table of claim 1 further comprising said sensor device is fastened to said tabletop.

5. The table of claim 1 further comprising said sensor device is fastened in said operating device.

6. The table of claim 1 further comprising said sensor device is integrated in said control device.

7. The table of claim 1 further comprising said operating device has a manual switch device.

8. The table of claim 1 further comprising said table has a display device which is configured to display the location and/or the magnitude of a determined inclination change of the tabletop.

9. The table of claim 1 further comprising said table has a database which is configured to store the location and/or the magnitude of a determined inclination change of said tabletop.

10. The table of claim 1 further comprising said display device is in the vicinity of or inside said operating device.

11. A method for controlling an electrically height-adjustable table wherein the table comprises an electrically height-adjustable base frame, a tabletop arranged at or on the base frame, a drive device for adjusting the height of the base frame and the tabletop, wherein the drive device is fastened to the base frame or to the tabletop and comprises at least one electric motor, a control device and an operating device for operating the control device, and a sensor device for detecting an initial absolute inclination of the tabletop upon receiving an input of a movement command via the operating device and for detecting a subsequent absolute inclination and a subsequent temporal inclination change of the tabletop during movement of the tabletop up or down according to the movement command, wherein the sensor device comprises a three-axis acceleration sensor for determining the absolute inclination of the tabletop and a three-axis gyroscope for determining the temporal inclination change of the tabletop, comprising:

receiving, at the operating device, an input of a movement command by a user, determining, in response to the movement command, an initial absolute inclination of the tabletop by means of the computing device by initially capturing acceleration components via the acceleration sensor in a three-dimensional Cartesian coordinate system oriented on the basis of the installation orientation of the acceleration sensor and comparing the captured acceleration components with known acceleration components under the same conditions in a global three-dimensional Cartesian coordinate system, wherein the z-axis of the coordinate system is oriented in the direction of gravitational acceleration, and subsequently moving the tabletop up or down according to the movement command via the drive device, and determining an absolute inclination of the tabletop by capturing acceleration components by means of the acceleration sensor and determining a temporal inclination change of the tabletop or a variable representative of the temporal inclination change of the tabletop by means of the computing device during the movement of the tabletop, wherein the temporal inclination change of the tabletop is determined by capturing angular velocity components via the gyroscope.

12. The method of claim 11, further comprising stopping the drive device or controlling the drive device in the opposite direction if the determined sum of the angular velocity components exceeds the angular velocity limit value, or exceeds a predefined inclination limit value.

13. The method of claim 11, further comprising controlling the drive device, by means of the control device, on the basis of the determined inclination or determined temporal inclination change of the tabletop or determined variable representative of the temporal inclination change of the tabletop.

14. The method of claim 11, further comprising displaying, by means of the display device, the location and/or the magnitude of a determined inclination change of the tabletop.

15. The method of claim 11, further comprising storing, by means of the database, the location and/or the magnitude of a determined inclination change of the tabletop.

16. The method of claim 11 further comprising correcting the offset of the captured acceleration components.

17. The method of claim 11 further comprising inverting the acceleration component in the z direction and converting the captured acceleration components into an inclination angle or vector.

18. The method of claim 11 further comprising captured acceleration components are offset-corrected and/or inverted.

19. The method of claim 11 further comprising inverting the angular velocity components and summing the angular velocity components and comparing the determined sum of the angular velocity components with a predefined angular velocity limit value.

20. The table of claim 1 further comprising said gyroscope is integral with said sensor device.

21. The table of claim 1 further comprising said acceleration sensor and said gyroscope are accommodated in a micro electromechanical systems (MEMS) component.

22. The table of claim 1 further comprising said computing device incorporates offset correction of the captured acceleration components.

23. The table of claim 1 further comprising said computing device incorporates inversion of the acceleration component in the z direction.

24. The table of claim 1 further comprising inverting said angular velocity components captured by said gyroscope.

* * * * *